United States Patent [19]

Streubel

[11] 4,223,715

[45] Sep. 23, 1980

[54] SEGMENT EXCHANGER APPARATUS FOR A CONTINUOUS CASTING INSTALLATION AND METHOD OF OPERATING THE SAME

[75] Inventor: Hans Streubel, Düsseldorf, Fed. Rep. of Germany

[73] Assignee: Concast AG, Zürich, Switzerland

[21] Appl. No.: 27,495

[22] Filed: Apr. 5, 1979

[30] Foreign Application Priority Data

Apr. 19, 1978 [CH] Switzerland ..... 4187/78

[51] Int. Cl.[3] ..... B22D 11/128

[52] U.S. Cl. ..... 164/1; 164/448

[58] Field of Search ..... 164/1, 441, 442, 447, 164/448; 193/17, 23

[56] References Cited

U.S. PATENT DOCUMENTS

| | | | |
|---|---|---|---|
| 2,799,378 | 7/1957 | English | 193/17 X |
| 3,763,923 | 10/1973 | Gallucci | 164/448 |

FOREIGN PATENT DOCUMENTS

| | | | |
|---|---|---|---|
| 1957690 | 5/1971 | Fed. Rep. of Germany . | |
| 46-17940 | 8/1971 | Japan . | |
| 47-18730 | 9/1972 | Japan . | |
| 378050 | 7/1975 | U.S.S.R. | 164/447 |

*Primary Examiner*—Robert D. Baldwin
*Attorney, Agent, or Firm*—Werner W. Kleeman

[57] ABSTRACT

A segment exchanger apparatus for a continuous casting installation and a method of operating the same is disclosed, wherein there is provided an at least partially curved strand guide or roller apron subdivided into segments. The segments are mounted in stationary, straight guides. It is possible to pull any selected segment, by means of a flexible traction element operated by a stationary crane or equivalent structure, out of its stationary guide and through an inner pivotable track section. A replacement segment can be introduced, through the inner track section, into the stationary guide.

10 Claims, 2 Drawing Figures

SEGMENT EXCHANGER APPARATUS FOR A CONTINUOUS CASTING INSTALLATION AND METHOD OF OPERATING THE SAME

BACKGROUND OF THE INVENTION

The present invention relates to a new and improved construction of segment exchanger apparatus for a continuous casting installation which is of the type comprising an at least partially curved strand guide or roller apron subdivided into segments. The segments are mounted in stationary guides, and an inner track section, pivotable about an essentially horizontal axis or pivot shaft, can be selectively adjusted at any one of the stationary guides. The invention further relates to a novel method of operating such segment exchanger apparatus.

The parts of the strand guide or roller apron of a continuous casting installation which encompass at least one pair of rolls or other conventional guide means, in the case of a curved arrangement, are usually referred to as segments. In order to assemble and dismantle these segments there are known to the art the most different constructions of segment exchanger equipment.

With a state-of-the-art segment exchanger apparatus the curved, successively arranged strand guide segments are mounted in stationary guides. These stationary guides enable any selected segment which is to be dismantled to initially be guided in a direction perpendicular to the direction of strand travel in the direction of the center of curvature of the strand guide, and thereafter to be deflected into a vertical path of travel. The segment is moved by the crane located at the casting platform. Since there is required a separate guide for each segment, there are needed a multiplicity of such guides. This impairs the accessibility to the strand guide or roller apron. Furthermore, the casting platform must be maintained free at a large region near to the continous casting mold, because the guides operatively associated with each segment must be able to guide the segments, at different locations, through openings provided at the casting platform. Furthermore, the casting platform also must be unobstructed so that the ladle operator can travel with the ladle over the relevant region of the casting platform.

These drawbacks should be avoided according to a heretofore known further development of this structure. The curved, stationary guides which are operatively correlated with each segment, in this case coact with a track section which is pivotable about a horizontal axis or pivot shaft. The inner pivotable track section is arranged on a carriage which can travel upon the casting platform. Upon the carriage there is arranged a respective winch for pivoting the track section and for withdrawing the segments. During the segment exchange operation the segment is pulled from the stationary guide onto the pivotable inner guide track and, by pivoting the track section into a horizontal position, the segment is lifted onto the casting platform. Thereafter, the segment is raised by a crane from the pivotable track section. The assembly work is accomplished in the reverse sequence.

On the one hand, this solution is expensive owing to the travelling arrangement of the pivotable inner track section, and, on the other hand, the entire displacement path of the carriage at the casting platform must be maintained unobstructed, so that at any time when a disturbance arises, it is possible to exchange segments.

The transfer of the segment from the winch to the crane and from the crane to the winch requires each time manual effort. Finally, the inner track section, during each segment exchange, must be pivoted throughout its entire length through an opening in the casting platform, so that, on the one hand, it is necessary to remove large cover elements at the casting platform, and, on the other hand, the pivotable track section must be alined twice at the stationary guides operatively associated with the segments to be exchanged. This results in a poor utilization of the surface of the casting platform, increases the danger of accidents by virtue of the large openings which are present in the casting platform, and furthermore, increases the time needed for the segment exchange operation.

SUMMARY OF THE INVENTION

Hence, with the foregoing in mind it is a primary object of the present invention to provide a new and improved construction of segment exchanger apparatus for a continuous casting installation and a method of operating the same, which is not afflicted with the aforementioned drawbacks and limitations of the prior art proposals.

Another and more specific object of the present invention aims at the provision of a new and improved construction of segment exchange apparatus which is priceworthy, both in terms of investment and maintenance costs, simple to use, and enables the segment exchange operation to be accomplished very quickly.

Still a further significant object of the present invention is to provide a new and improved construction of segment exchanger apparatus which, for the segment exchange work, impairs as little as possible the casting platform and the equipment provided for this purpose.

Yet a further significant object of the present invention aims at the provision of a new and improved construction of segment exchanger apparatus for a continuous casting installation and a method of operating the same, wherein the segment exchange work can be accomplished easily, reliably and relatively quickly.

Now in order to implement these and still further objects of the invention which will become more readily apparent as the description proceeds, the invention contemplates that each segment dismantling position of the pivotable inner track section has operatively associated therewith insertable arresting devices for the aligned positioning and supporting of the track section at the stationary guides. Moreover, guide surfaces of the track section and which are provided for guide elements of the segments, serve to rock or pivot the segment during its passage over and through the track section.

Consequently, it is possible to use as the lifting element for withdrawing the segments from the stationary guides a crane which is already present at continuous casting installations. The same crane can convey the segment, without unloading the same, to a segment exchange position and deposit such in a predetermined position which has been pivoted in relation to the installed position. The replacement segment thereafter can be engaged by the crane and brought back into the strand guide or roller apron, by means of the pivotable and the stationary track section. The pivotable track section, after dismantling a segment, advantageously remains in its position to enable a rapid mounting of the replacement or repaired segment. The inventive construction of the pivotable track section equally does not obstruct the casting platform, even in the case of continuous casting installations having arc-type or curved molds, since it is located far removed from the servicing region of the continuous casting mold. Furthermore, the arrangement of short, stationary guides allows for good accessibility to the strand guide or roller apron.

The inventive construction also enables pivoting the inner track section by means of the same crane which is subsequently used for displacing the segments. Due to the positioning and supporting of the track section by simple arresting devices, there is also realized a construction which is low in cost and maintenance, can be easily operated and possesses high accuracy in the segment exchange work.

In the case of continuous casting installations equipped with straight molds and a first straight roller apron section which follows the continuous casting mold, the dismantling of the segments of the curved roller apron section advantageously can be accomplished by means of a crane arranged below the casting platform. In this case there is eliminated any impairment or obstruction of the casting platform due to the segment exchange operation.

The method of operating the inventive segment exchanger is manifested by the features that the pivotable inner track section is rocked or pivoted by means of the crane arranged above the roller apron, selectively into a position operatively associated with one of the segments which is to be exchanged, then the arresting device is inserted, by means of the crane the flexible traction element is moved towards the segment to be exchanged and connected therewith, and then the segment is pulled out of its stationary guide and through the inner track section.

According to a further construction of the invention, it is advantageous if the stationary guides extend linearly and are aligned approximately at the center of curvature of the roller apron.

There can be used, by way of example, a wire cable as the connection element between the crane and the segment, this wire cable or equivalent structure being guided at the inner track section only over one deflection roll. According to a further advantageous feature of the invention a flexible traction element can be connected by means of a hinge or articulated coupling or equivalent structure with the segments. This flexible traction element can be constructed as a guide chain having a length approximately corresponding to the length of the guide track of the pivotable inner track section.

In order to guide the segments in the stationary guides and in the inner track section there can be employed conventional guide elements. Particularly advantageous in this regard is if these guide elements are constructed as guide wheels or rollers.

A particularly price worthy and advantageous solution can be realized if the inner track section, devoid of any drive, is pivoted by means of the crane arranged above the casting platform. Of course, it is also possible to use other drive elements for the pivotal movement of the inner track section.

In the case of multi-strand installations it is possible to achieve a further saving in costs if, for a number of strands, there is used the same driveless inner track section. As an additional advantage the invention thus further proposes that the inner track section, in the case of a multi-strand installation, can be selectively connected and disconnected over each roller apron. According to a further feature of the invention, in the case of continuous casting installations working with curved continuous casting molds and a curved roller apron defined by one or a number of radii, the pivot axis or shaft of the inner track section can be arranged eccentrically with respect to the curved roller apron and below the casting platform. The stationary guides can possess different lengths in accordance with the eccentric mounting.

Consequently, there is achieved the result that the pivotable track section always remains below the casting platform and there is required, only at one location removed from the mold, a throughpass opening in the casting platform which is approximately of the size of the cross-section of a segment.

A further advantage of the invention resides in the fact that the pivotable inner track section possesses lower and upper guide surfaces. The upper guide surfaces are curved in the sense of widening the guide track towards the casting platform and the lower guide surfaces run-out in the same direction with a larger radius of curvature. Further, these guide surfaces form both for the segment and also for a guide chain attached as a traction element at the crane, transition track curves or sections.

In this way, for every pivotal position of the pivotable inner track section there are ensured optimum conditions during the introduction of the traction element and the segment, respectively.

In order to be able to center the segments in the mounting position, it is additionally furthermore possible according to the invention, to arrange at a support frame centering guides for runners or skids or equivalent structure arranged at the segments. In this way also the guide wheels are relieved of load during operation.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
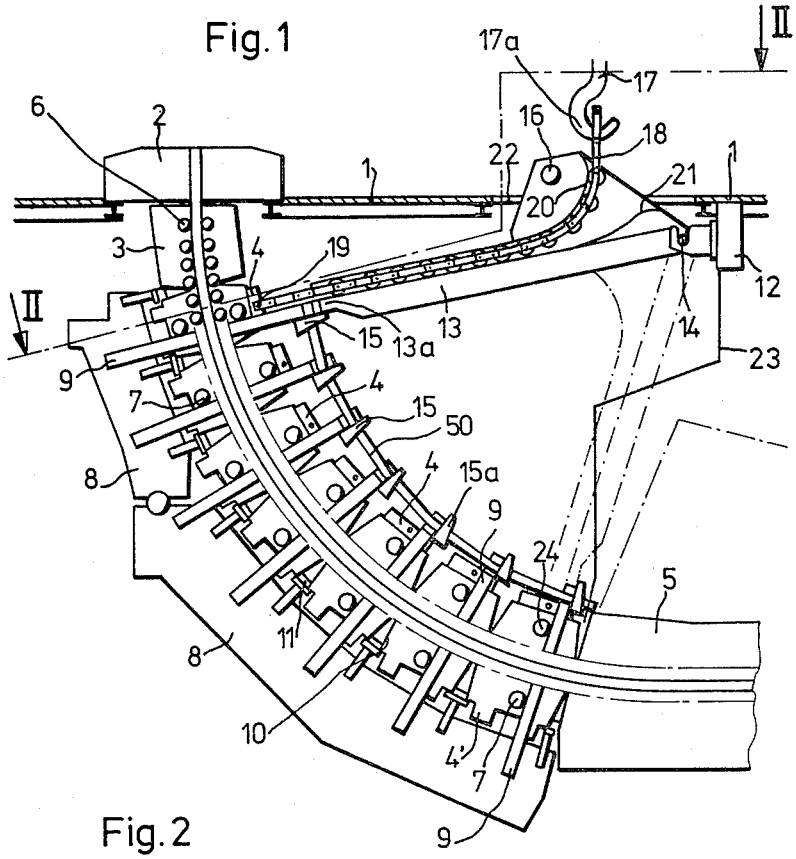
FIG. 1 is a side view of a curved continuous casting installation equipped with a segment exchanger apparatus according to the invention.
Figure 2:
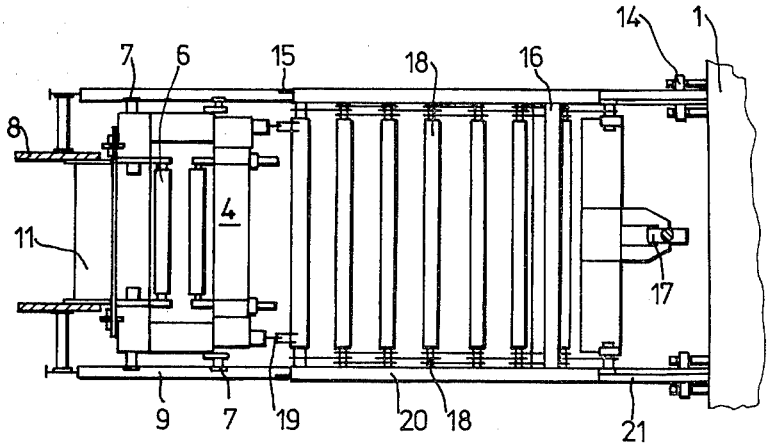
FIG. 2 is a cross-sectional view of the arrangement of FIG. 1, taken substantially along the line II—II thereof.

Describing now the drawings, it is to be understood that there has only been illustrated therein enough of the continuous casting installation or plant to enable those skilled in the art to readily understand the underlying principles and concepts of the invention. Referring more specifically to FIGS. 1 and 2, the therein continuous casting installation for a metal, typically steel, has a curved or arc-type continuous casting mold 2 arranged upon a casting platform 1. Following the continuous casting mold 2 there is arranged a strand guide arrangement or roller apron, which extends in an arc or curved path until terminating in an essentially horizontal plane. The strand guide arrangement or roller apron comprises a first zone 3, an intermediate portion or section formed of the roller apron segments 4, and a withdrawing and straightening machine 5 which extends into the horizontal plane.

Each of the roller apron segments 4, equipped with conventional guide rolls 6 as best seen by referring to FIG. 2, is provided with lateral guide wheels 7 capable of travelling upon the stationary guides or guide means 9 attached to a support frame or framework arrangement 8. The stationary guides or guide means 9 extend linearly and are aligned approximately with the center of curvature of the roller apron or strand guide arrangement. Arranged at the segments 4 are runners or skids 10 or equivalent structure which, at the region of assembly of the segments 4, can be moved into engagement with centering guides 11 secured to the support frame arrangement 8, so that the guide wheels or rolls 7 are relieved of load in the assembled or mounted position of the roller apron segments 4.

At a longitudinal support 12 there is pivotably mounted, about a horizontal pivot shaft or axis 14, an inner track section 13 whose free end 13*a* can be selectively brought into aligned position with each of the stationary guides 9. With an arrangement wherein the pivot shaft 14 of the inner track section 13 is located eccentrically with regard to the curved roller apron and below the casting platform 1, it is advantageous for the stationary guides 9 to have different lengths in accordance with the eccentric mounting. Operatively associated with each dismantling position for the segments 4 are insertable or displaceable arresting devices 15 which enable the aligned positioning and supporting of the track section 13 at each of the related stationary guides 9. Different constructions of arresting devices 15 can be employed, and in the exemplary embodiment shown, such arresting devices 15 comprise substantially wedge-shaped arresting elements 15*a* displaceably mounted for to-and-fro movement in support means 50 and adjacent the related stationary guide 9. Each of such wedge-shaped arresting elements 15*a* can be moved back-and-forth, as desired, either manually or by any suitable drive, such as a suitable hydraulic piston-and-cylinder unit (not shown). The positional adjustment of the inner track section 13 at the individual stationary guides 9 is accomplished by a suitable powering device, here shown as a crane, generally indicated by reference character 17 whose crane hook 17*a* can engage with a connection element 16 of the track section 13. In the drawing, the inner track section 13 has been shown positionally adjusted so as to coact with the stationary guide or guide means 9 for the uppermost segment 4. Adjustment of the track section 13 so as to coact with the guide means 9 for the lowermost segment 4' has been shown in phantom lines in FIG. 1.

The exchange of the segments 4 is accomplished by the crane 17 and a suitable traction element, here shown as a guide chain 18 suspended at the crane 17 and having a length approximately corresponding to the length of the guide track of the track section 13. This guide chain 18 is guided in the inner track section 13. Guide chain 18 is connected with any given segment 4 by a hinge or articulated coupling means here shown as the bolts 19.

So that for each pivotal position of the inner track section 13 it is possible to easily insert into as well as again remove from the inner track section 13 both the guide chain 18 and equally a segment 4, there are beneficially provided upper guide surfaces 20 of the inner track section 13 which are curved towards the casting platform 1 in a manner which widens the path of travel or track in the direction of such casting platform 1. Equally, there are provided lower guide surfaces 21 which are curved in the same direction but have a larger radius of curvature. The upper and lower guide surfaces 20 and 21 form a curved or bent funnel-like structure or path at one side of the track section 13. Due to this configuration there is achieved the advantage that the guide surfaces 20 and 21, structured to coact with the guide wheels 7, pivot all of the segments 4 during their passage on the track section 13 and bring such segments into an advantageous position for depositing thereof. Both the uppermost segment 4 as well as the lowermost segment 4' can be removed in one operation with the same track section 13 and there can be inserted a replacement segment 4. All segments 4 can be inserted and removed through the same small opening 22 provided at the casting platform 1.

In the exemplary embodiment under discussion there is mounted a cooling chamber wall means 23 after the last segment 4'. This wall means or wall 23 is pivotably mounted at its underside, so that the track section 13 can be aligned with the stationary guide or guide means 9 of the lowermost segment 4'. This position has been shown in phantom lines in FIG. 1.

In the case of multi-strand casting installations, the inner track section 13 can be arranged so that it can be easily suspendingly connected and disconnected, in order to thus be able to service a number of strands.

While there are shown and described present preferred embodiments of the invention, it is to be distinctly understood that the invention is not limited thereto, but may be otherwise variously emboded and practiced within the scope of the following claims.

Accordingly, what I claim is:

1. A segment exchanger apparatus for a continuous casting installation comprising:

at least partially curved roller apron means subdivided into segments;

support frame means for mounting the segments, said support frame including stationary guide means for each segment;

an inner track section;

means for mounting said inner track section to be pivotal about a substantially horizontal axis so as to selectively be positionally adjustable with respect to any predetermined one of said stationary guide means;

displaceable arresting means provided to cooperate with said pivotable inner track section for the aligned positioning and supporting of the track section at any of the stationary guide means for each segment dismantling position of the pivotable inner track section;

said segments being provided with dismantling guide elements;

said track section having guide surface means near the track section mounting means which, upon passage of any segment upon said track section, cooperates with the dismantling guide elements of the throughpassing segment for pivoting said segment during its throughpassage.

2. The segment exchanger apparatus as defined in claim 1, wherein:

said roller apron means has a center of curvature; and each of the stationary guide means extending essentially linearly and being directed approximately towards the center of curvature of the roller apron means.

3. The segment exchanger apparatus as defined in claim 1, wherein:

said pivotable inner track section defines a guide path for the segment;

a guide chain having a length approximately corresponding to the guide path of the pivotable inner track section; and hinge coupling means for connecting the guide chain with any selected one of the segments.

4. The segment exchanger apparatus as defined in claim 1, wherein:

the guide elements of each of the segments comprise guide wheels.

5. The segment exchanger apparatus as defined in claim 1, wherein:

said inner track section defines a driveless track section;

a casting platform; and powering means for the track section arranged above said casting platform.

6. The segment exchanger apparatus as defined in claim 5, wherein:

said powering means comprises crane means for pivoting said inner track section.

7. The segment exchanger apparatus as defined in claim 1, for use with a continuous casting installation equipped with a curved continuous casting mold and curved roller apron means and a casting platform, wherein:

said means for pivotably mounting said inner track section is arranged eccentrically with respect to said curved roller apron means and below the casting platform; and said stationary guide means possess different lengths in accordance with the eccentric mounting of said inner track section.

8. The segment exchanger apparatus as defined in claim 1, wherein:

said continuous casting installation includes a casting platform and a crane means provided with a traction element;

said guide surface means of said track section comprising lower and upper guide surface means;

said upper guide surface means being curved so as to widen the inner track section in the direction of the casting platform;

the lower guide surface means being curved in the same direction as said upper guide surface means but having a larger radius of curvature; and said upper and lower guide surface means forming transition curve means both for the segment which is handled by the track section and for a guide chain attached as said traction element at the crane means.

9. The segment exchanger apparatus as defined in claim 1, further including:

centering guide means arranged at said support frame means for coacting with runners provided at the segments.

10. A method of operating a segment exchanger apparatus for a continuous casting installation comprising the steps of: providing at least partially curved roller apron means subdivided into segments, support frame means for mounting the segments, said support frame including stationary guide means for each segment, an inner track section mounted for pivotable movement about a substantially horizontal pivot axis so as to be selectively positionally adjustable with respect to any predetermined one of the stationary guide means, displaceable arresting means provided to cooperate with said pivotable inner track section for the aligned positioning and supporting of the track section at any one of the stationary guide means for each segment dismantling position of the pivotable inner track section, said segments being provided with dismantling guide elements, and said track section having guide surface means near the track section mounting means which, upon passage of any segment upon said track section, cooperates with the dismantling guide element of the throughpassing segment for pivoting said segment during its throughpassage;

engaging the pivotable inner track section by means of a powering means arranged above the roller apron means;

moving the engaged pivotable inner track section selectively into a position for coaction with a given one of the segments which is to be exchanged;

inserting the arresting means in order to positionally fix said pivotable inner track section so as to coact with the stationary guide means of the segment to be exchanged;

moving a flexible traction element by means of said powering means so as to be capable of engaging with the segment to be exchanged and connecting the flexible traction element with the segment; and then drawing the segment to be exchanged out of its stationary guide means and through said inner track section.

* * * * *

UNITED STATES PATENT AND TRADEMARK OFFICE

CERTIFICATE OF CORRECTION

PATENT NO. : 4,223,715

DATED : September 23, 1980

INVENTOR(S) : Hans Streubel

It is certified that error appears in the above—identified patent and that said Letters Patent is hereby corrected as shown below:

On the title page, column 1, section [73], please read:

"CONCAST AG, Zürich, Switzerland" as:

--SCHLOEMANN-SIEMAG AG, Düsseldorf, The Federal Republic of Germany--

Signed and Sealed this

*Thirtieth* Day of *June 1981*

[SEAL]

*Attest:*

RENE D. TEGTMEYER

*Attesting Officer*

*Acting Commissioner of Patents and Trademarks*